US006971765B2

(12) United States Patent
Wu

(10) Patent No.: US 6,971,765 B2
(45) Date of Patent: Dec. 6, 2005

(54) FUNCTION CONTROLLABLE DECORATIVE LIGHTING EQUIPMENT

(76) Inventor: Jeng-shyong Wu, No. 14, Alley 1, Lane 326, Shin-Pin Road, Hsinchu (TW)

( * ) Notice: Subject to any disclaimer, the term of this patent is extended or adjusted under 35 U.S.C. 154(b) by 132 days.

(21) Appl. No.: 10/462,621

(22) Filed: Jun. 17, 2003

(65) Prior Publication Data

US 2004/0257809 A1 Dec. 23, 2004

(51) Int. Cl.[7] ..... F21V 33/00
(52) U.S. Cl. ..... 362/234; 362/249; 362/250; 362/251; 362/252
(58) Field of Search ..... 362/234, 253, 362/249–252; 313/323, 623, 572, 573, 318.12, 313/315, 149

(56) References Cited

U.S. PATENT DOCUMENTS

| | | | | |
|---|---|---|---|---|
| 5,379,202 | A * | 1/1995 | Daun | 362/252 |
| 6,082,867 | A * | 7/2000 | Chien | 362/84 |
| 6,126,298 | A * | 10/2000 | Wu | 362/252 |
| 6,746,885 | B2 * | 6/2004 | Cao | 438/26 |
| 6,854,863 | B2 * | 2/2005 | Wu | 362/292 |
| 2004/0120687 | A1 * | 6/2004 | Fung | 385/147 |

* cited by examiner

*Primary Examiner*—Thomas M. Sember
*Assistant Examiner*—James W Cranson, Jr.
(74) *Attorney, Agent, or Firm*—Troxell Law Office, PLLC

(57) ABSTRACT

A function controllable decorative lighting equipment is disclosed. The light source is a tungsten incandescent lamp or a LED. A heat sensitive, a light sensitive or a combination of IC and other electronic elements are employed as function controllable device for the decorative lighting equipment. These function controllable devices are connected in series, parallel, or series-parallel with the light sources so as to exhibit a unique lighting effect according to variation of external temperature or light intensity.

36 Claims, 6 Drawing Sheets

FUNCTION CONTROLLABLE DECORATIVE LIGHTING EQUIPMENT

BACKGROUND OF THE INVENTION

1. Field of the Invention

The present invention relates to function controllable decorative lighting equipment, and more particularly, to the decorative lighting equipment consisting of a function controllable device formed of a heat sensitive element, a light sensitive element, or an IC electronic unit which controls the light output of the decorative lighting equipment to exhibit a unique lighting effect according to variation of external temperature or light intensity.

2. Description of the Prior Art

In a conventional lighting equipment, it essentially consists of a light source such as an incandescent lamp connected to a power source with a conductor. As for the decorative lighting equipment, it is more complicatedly constructed with a string of lamps contoured in a unique profile such as an artificial tree, and its on-off control is performed by an IC unit connected with the lamps so as to cause the group of lamps to turn on and turn off in a definite order thereby exhibiting a special decorative lighting effect as if twinkling starts. This decorative lighting equipment is favorably used in festivals and commercial advertisements where an appealing accent lighting is required. However, the performance of the conventional decorative lighting constructed as such is too monotonous, and more variety in lighting effect shall be added.

In order to palliate the inherent shortcoming of the conventional decorative lighting equipment, the inventor of the present invention herein provides an innovative function controllable decorative lighting equipment which will fully meet with the user's requirements.

SUMMARY OF THE INVENTION

The main object of the present invention is to provide an innovative decorative lighting equipment consisting of a function controllable device formed of a heat sensitive element, or an IC electronic device to control or regulate the light output thereby exhibiting a unique lighting effect according to variation of external temperature or light intensity.

To achieve the aforesaid object, the function controllable decorative lighting equipment of the present invention contains a polymeric positive temperature coefficient (PPTC) element to act as a heat sensitive device, a photoelectric cell as a light sensitive device, and combination of SCR and resistor as an IC electronic control unit to control or regulate the light output.

In the present invention, these functional devices can be connected in series, parallel, or series-parallel between the lighting element and the lead wires, or between the lead wires, so as to exhibit a special decorative lighting effect with a variety of appealing lighting patterns to entertain the public.

BRIEF DESCRIPTION OF THE DRAWINGS

The above object and other advantages of the present invention will become more apparent by describing in detail the preferred embodiments of the present invention with reference to the attached drawings in which.

DETAILED DESCRIPTION OF THE PREFERRED EMBODIMENT

Figure 1:
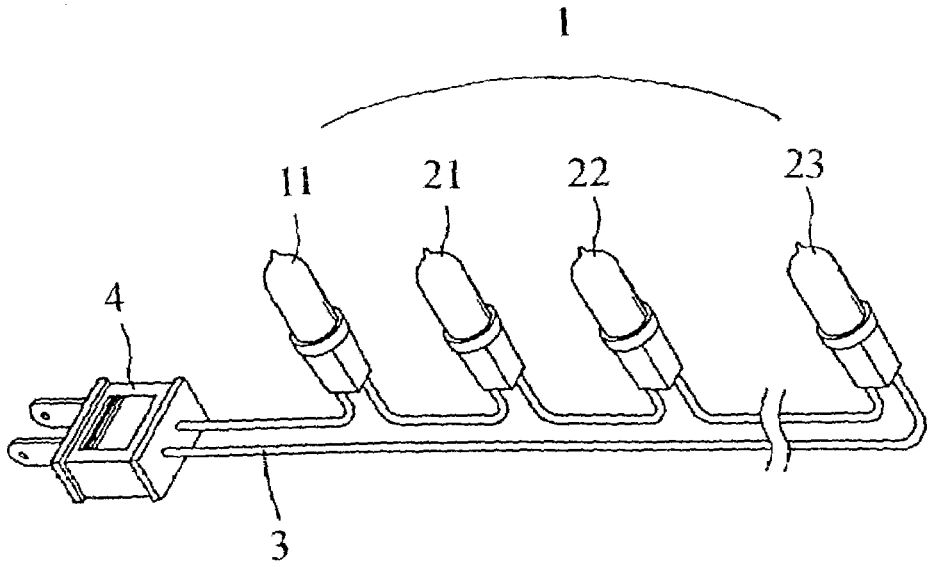
FIG. 1 is a representative assembly view of the function controllable decorative lighting equipment in a plurality of embodiments according to the present invention.

Referring to FIG. 1, the function controllable decorative lighting equipment of the present invention comprises a light emitting unit 1, a conductor 3, and a plug 4. The light emitting unit 1 is composed of a pure light source 11 and several function controllable light sources 21, 22, 23 connected with conductor 3 therebetween, and one end of the conductor 3 is provided with a plug 4 to be connected to a power supply.

Figure 2:
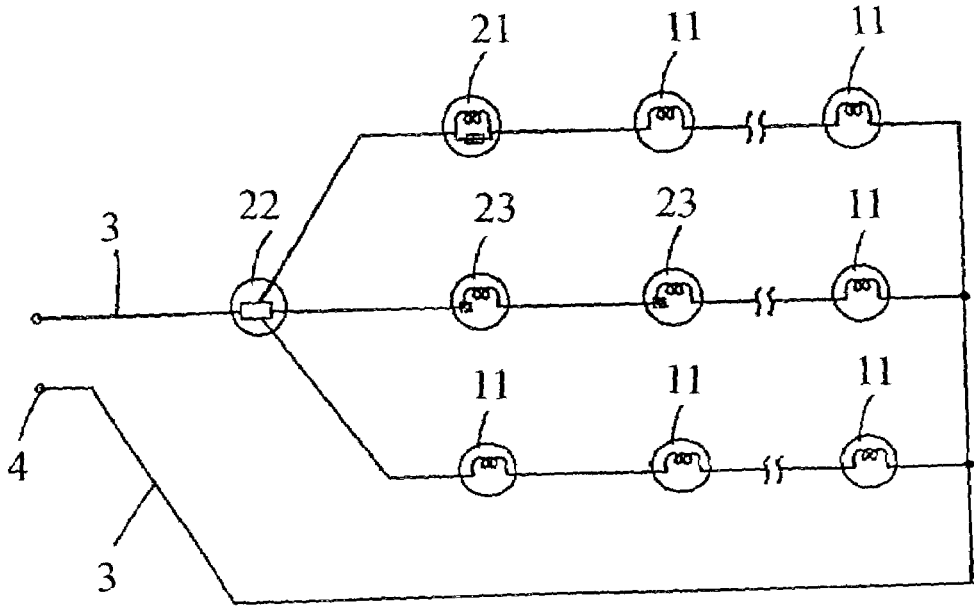
FIG. 2 is a typical circuit diagram of the present invention.

Referring to a typical circuit diagram of the present invention shown in FIG. 2, the circuit may be composed of three parallel branches, i.e. three pure light sources 11 connected in series as a first branch; a pure light source 11 and two function controllable light sources 23 connected in series as a second branch; and two pure light sources 11 and a function controllable light source 21 connected in series as a third branch, then these three parallel branch circuits are connected to the function controllable light source 22 thus forming a unique circuit layout for the decorative lighting equipment.

Figure 4:
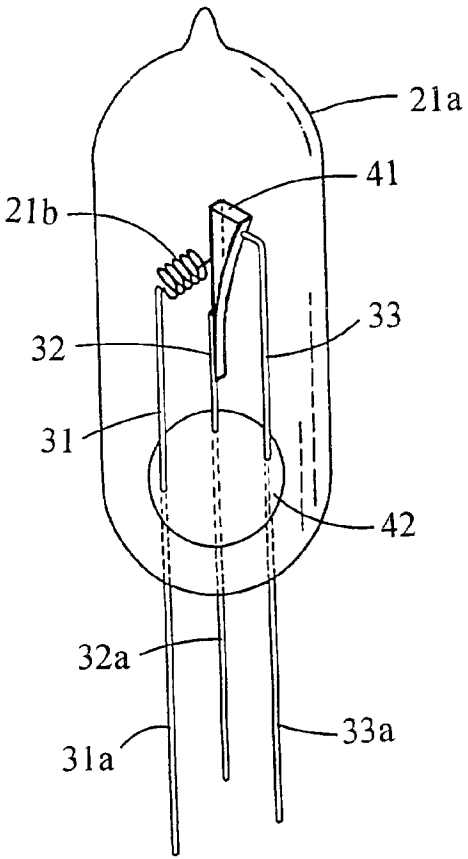
FIG. 4 is a partially enlarged view of FIG. 3.
Figure 3:
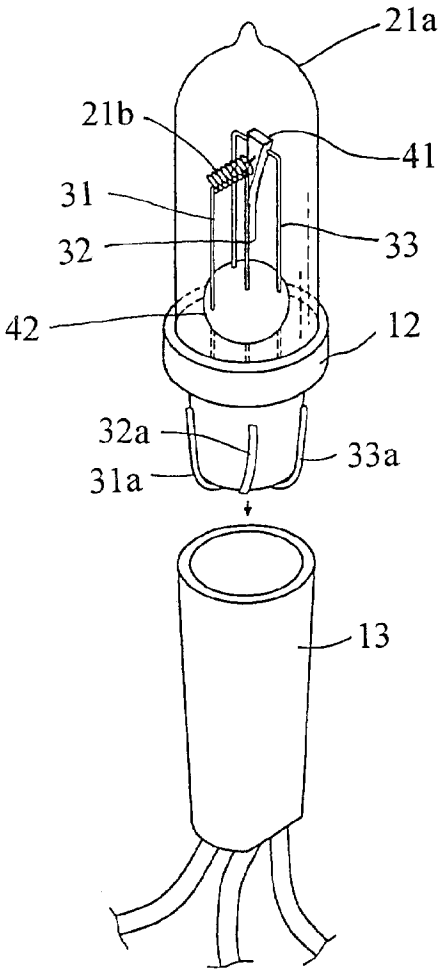
FIG. 3 is a three-dimensional exploded view of the present invention.

Referring to FIG. 3 together with FIG. 4, the pure light source 11 may be a tungsten lamp or a LED, as for the function controllable light source 21, is composed of a tungsten lighting element 21*b* or a LED enclosed in a bulb 21*a*, and a PPTC function controllable device 41 attached to one side of the lighting element 21*b* by means of a lead wire 33. The PPTC function controllable device is made of a polymeric material which has a heat sensitive positive temperature coefficient property. The lower end of lead wires 31, 32, 33 connecting with the lighting element 21 or PPTC function controllable device 41 pierces through an insulation base 12 installed beneath the lighting element 21*b* and then cambers upwards to adhere on the side surface of the insulation base 12 so as to form extension lead wires 31*a*, 32*b*, 33*a*. There is a pallet 42 provided above the insulation base 12 for supporting the lead wires 31, 32, 33 to keep them erect. Afterwards, the entire insulation base 12 together with the adhered lead wires 31, 32, 33 are sleeved into an insulation bushing 13, and the total lighting unit is connected to the power supply with the conductor 3.

Figure 5:
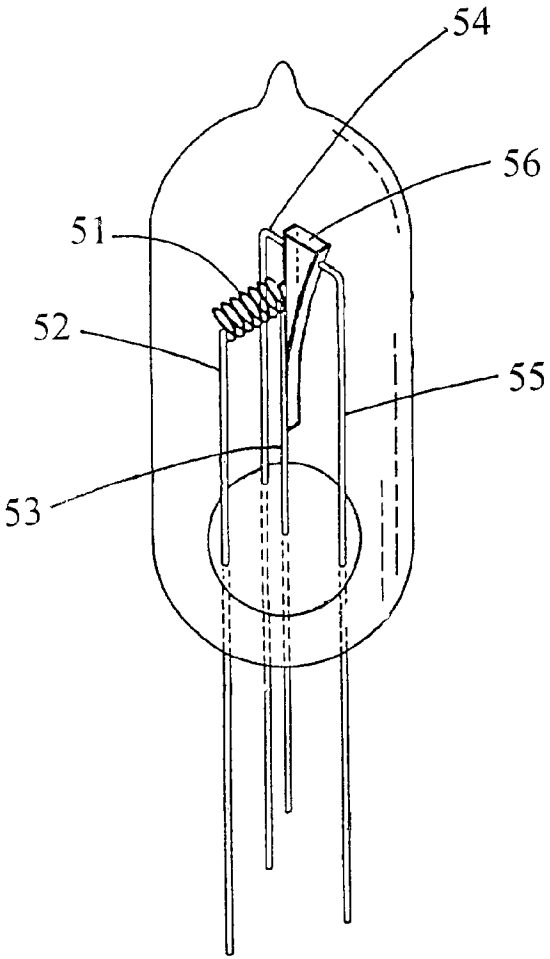
FIG. 5 is a second embodiment of the present invention.

In the second embodiment shown in FIG. 5, the PPTC function controllable device 56 is attached to one side of the tungsten lighting element 51, where both of them are connected to the power supply with lead wires 52, 53, and 54, 55 respectively.

Figure 6:
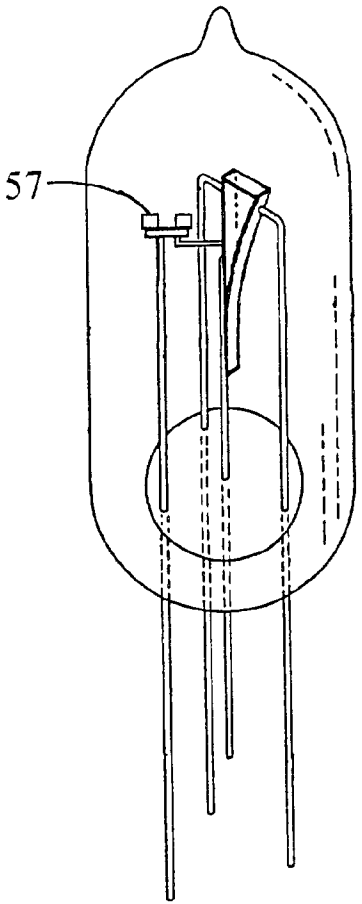
FIG. 6 is a third embodiment of the present invention.

In the third embodiment shown in FIG. 6, a LED 57 is used as the light source instead of the tungsten lighting element 51.

Figure 7:
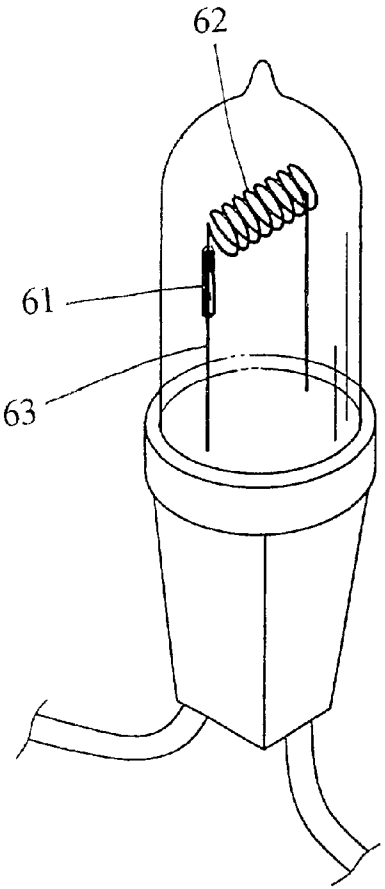
FIG. 7 is a fourth embodiment of the present invention.

In the fourth embodiment shown in FIG. 7, an IC function controllable device 61 is inserted between a tungsten lighting element 62 (or LED) and its lead wire 63.

Figure 8:
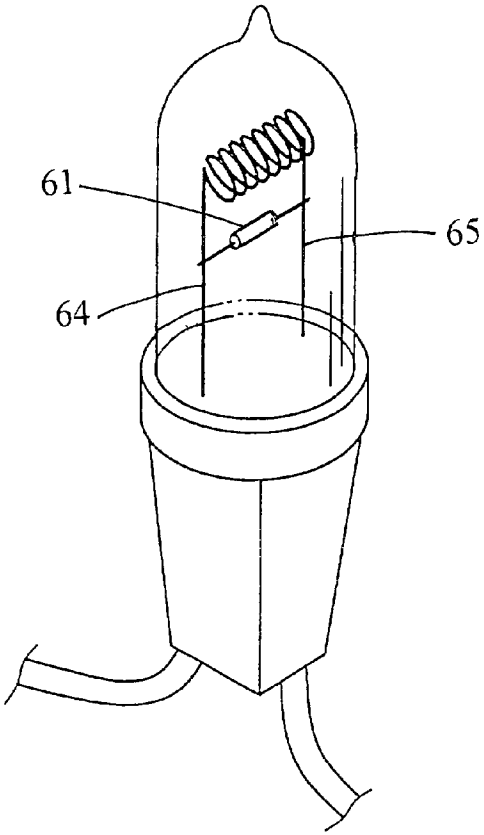
FIG. 8 is a fifth embodiment of the present invention.

In the fifth embodiment shown in FIG. 8, the IC function controllable device 61 is connected in parallel with the tungsten lighting element 62 underneath between downwardly erected lead wires 64 and 65.

Figure 9:
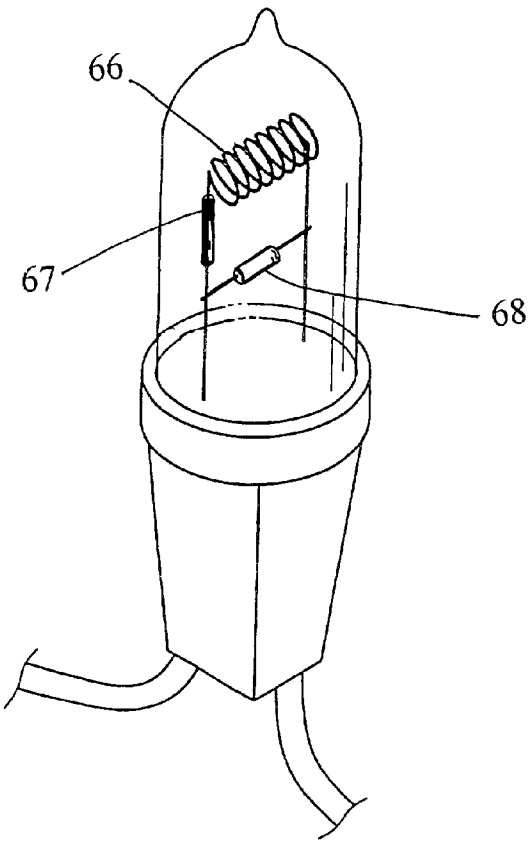
FIG. 9 is a sixth embodiment of the present invention.

In the sixth embodiment shown in FIG. 9, an extra IC function controllable device 67 is connected in series with a tungsten lighting element 66 above an IC function controllable device 68 which is connected in parallel with the tungsten lighting element 66.

Figure 10:
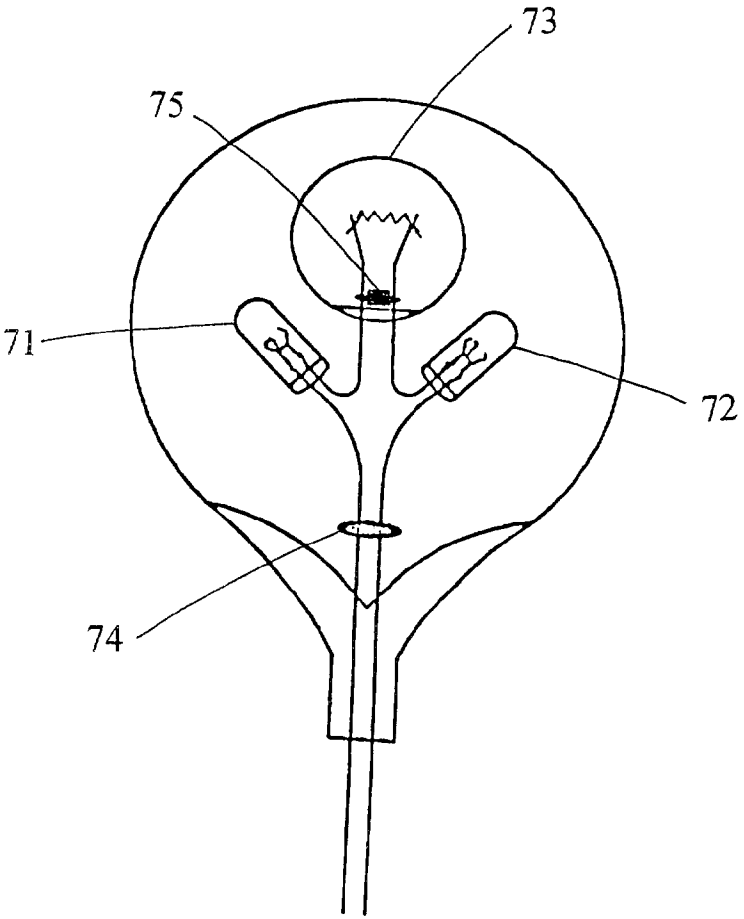
FIG. 10 is a seventh embodiment of the present invention.

In the seventh embodiment shown in FIG. 10, two LEDs 71, 72 and one tungsten lighting element 73 are radially disposed and interconnected with lead wires and sustained by a supporting means 74. An IC function controllable device 75 is connected in parallel with the tungsten lighting element 73 thereunder to control it exclusively.

Figure 11:
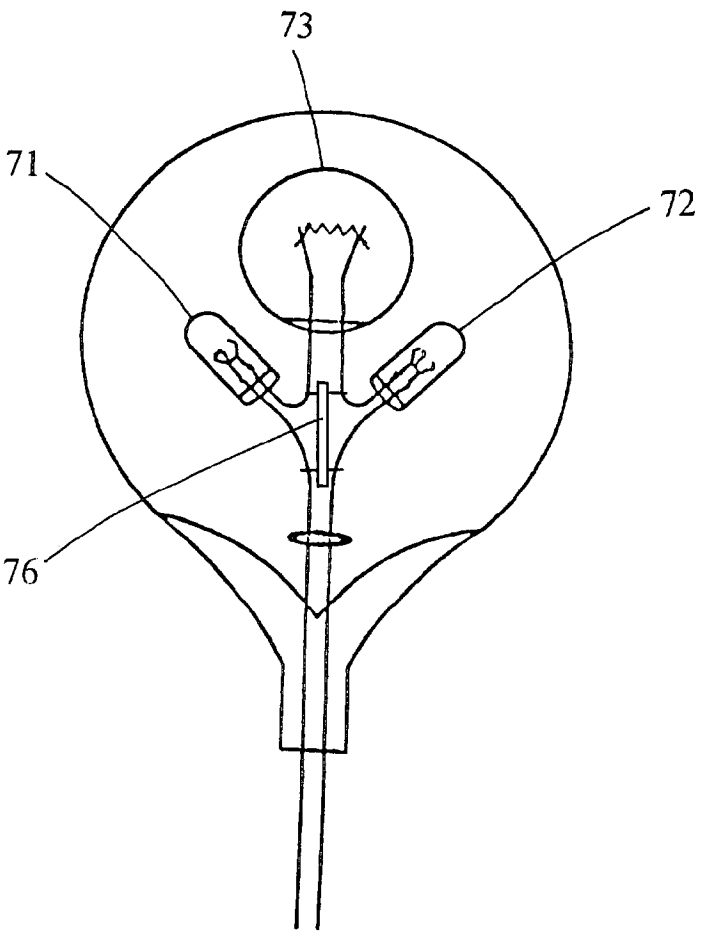
FIG. 11 is an eighth embodiment of the present invention.

In the eighth embodiment shown in FIG. 11, an IC function controllable device 76 is provided in common for two LEDs 71, 72 and one tungsten lighting element 73. The three lighting elements 71, 72, 73 share the control of the IC function controllable device 76.

Figure 12:
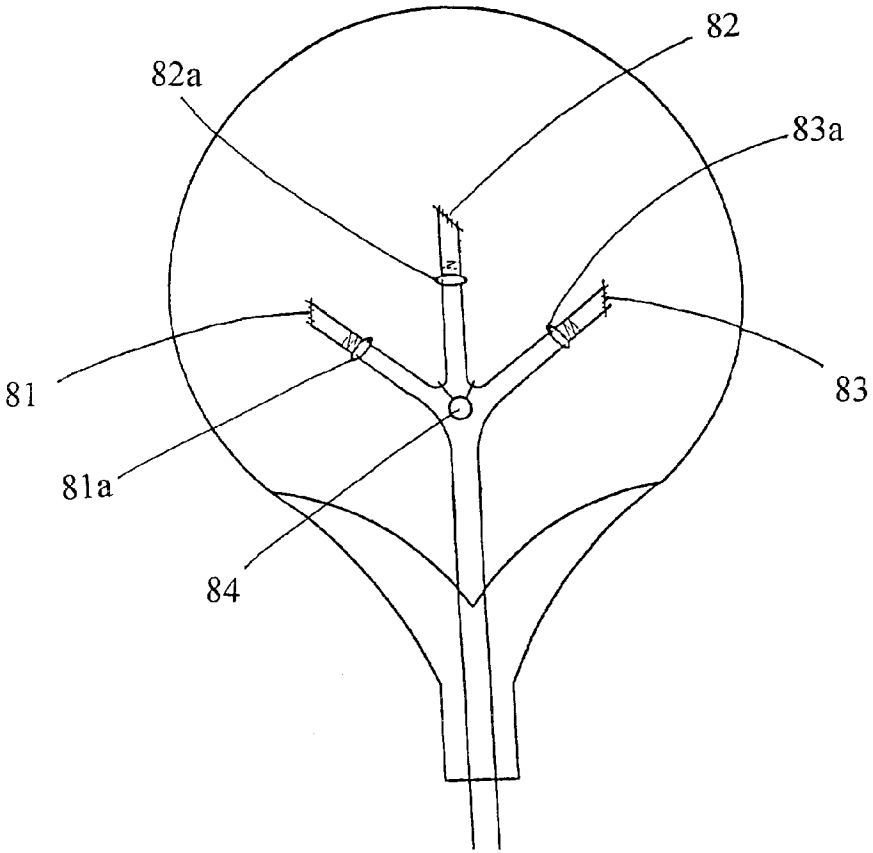
FIG. 12 is a ninth embodiment of the present invention.

In the ninth embodiment shown in FIG. 12, three tungsten light emitting elements 81, 82, 83 are radially disposed in a bulb where each pair of their lead wires are fixed with pallets 81*a*, 82*a*, 83*a* respectively. A light sensitive function controllable device 84 is equipped beneath one of the three tungsten light emitting elements for controlling said element only.

Figure 13:
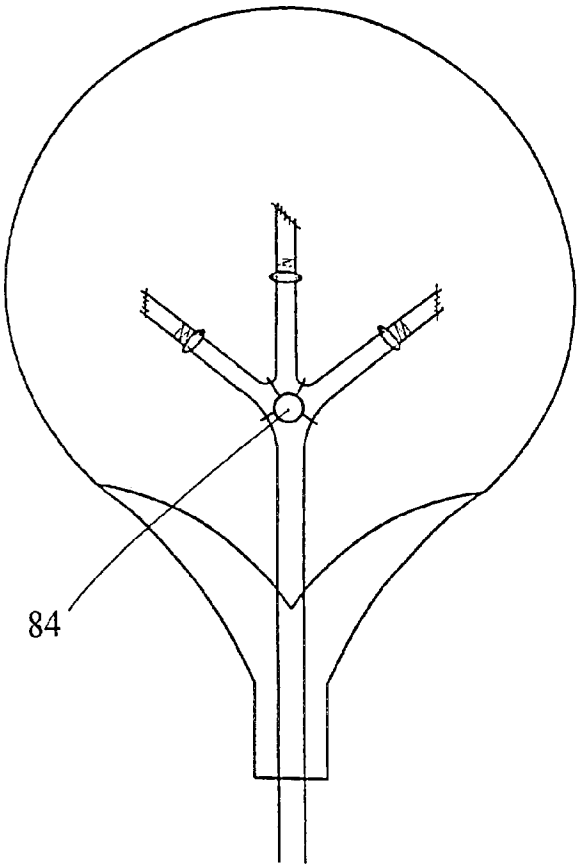
FIG. 13 is a tenth embodiment of the present invention.

In the tenth embodiment shown in FIG. 13, the light sensitive function controllable device 84 is installed in the manner to control all the three light emitting elements simultaneously.

It is understood from the above description that the versatile decorative lighting equipment of the present invention is able to exhibit a unique decorative lighting effect with a variety of appealing lighting patterns to entertain the public by means of function controllable devices such as a heat sensitive PPTC element, a light sensitive photoelectric cell, and a combined SCR and resistor IC control unit to control the light output.

Those who are skilled in the art will readily perceive how to modify the invention. Therefore, the appended claims are to be construed to cover all equivalent structures which fall within the true scope and spirit of the invention.

What is claimed is:

1. Function controllable decorative lighting equipment comprising:

a light emitting unit composed of a plurality of light sources, each containing a lighting element, both sides of each lighting element being connected with a lead wire;

at least one function controllable device being provided to at least one light source in said light emitting unit, and being in connection with said light emitting unit;

a plurality of conductors being connected at least one of said light sources, and a plug connector connecting said conductors to a power supply, wherein said function controllable device is formed of a heat sensitive element capable of responding to variation of ambient temperature, wherein said heat sensitive element is made of polymeric substance having positive temperature coefficient.

2. Function controllable decorative lighting equipment comprising:

a light emitting unit composed of a plurality of light sources, each containing a lighting element, both sides of each lighting element being connected with a lead wire;

at least one function controllable device being provided to at least one light source in said light emitting unit, and being in connection with said light emitting unit;

a plurality of conductors being connected at least one of said light sources, and a plug connector connecting said conductors to a power supply, wherein said function controllable device is formed of a light sensitive element capable of responding to variation of environmental light intensity, wherein said light sensitive element is a combination of photoelectric cell, SCR, and resistor.

3. Function controllable decorative lighting equipment comprising:

a light emitting unit composed of a plurality of light sources, each containing a lighting element, both sides of each lighting element being connected with a lead wire;

at least one function controllable device being provided to at least one light source in said light emitting unit, and being in connection with said light emitting unit;

a plurality of conductors being connected at least one of said light sources, and a plug connector connecting said conductors to a power supply, wherein said function controllable device is connected in parallel with said light emitting element between two lead wires beneath said light emitting element.

4. Function controllable decorative lighting equipment comprising:

a light emitting unit composed of a plurality of light sources, each containing a lighting element, both sides of each lighting element being connected with a lead wire;

at least one function controllable device being provided to at least one light source in said light emitting unit, and being in connection with said light emitting unit;

a plurality of conductors being connected at least one of said light sources, and a plug connector connecting said conductors to a power supply, wherein two said function controllable devices are provided beneath said light emitting element connected either in series with said light emitting element between said light emitting element and said lead wire, or in parallel with said light emitting element between two lead wires.

5. Function controllable decorative lighting equipment comprising:

a functional controllable light source where each of its light emitting elements being connected with one end of each lead wire, function controllable devices being connected in series, or parallel, or series-parallel with said light emitting elements between said light emitting elements and said lead wires, or between said lead wires wherein the whole lighting equipment is enclosed in a bulb housing, and extending other terminals of said lead wires out of said bulb housing to a power supply; and connecting means having a plurality of conductors being connected with said extension lead wires of at least one function controllable device in series, or parallel, or series-parallel, and then being connected to said power supply via said connecting means; wherein said light emitting elements produce light variation effect individually or simultaneously.

6. The lighting equipment as in claim 5, wherein said lighting equipment is protected by an insulation base.

7. The lighting equipment as in claim 5, wherein said lighting element is a tungsten filament.

8. The lighting equipment as in claim 5, wherein said lighting element is a LED.

9. The lighting equipment as in claim 5, wherein said lighting elements are individually operated or combinatorially operated so as to produce a monochromatic light or a variety of lights.

10. The lighting equipment as in claim 5, wherein said function controllable device is formed of a heat sensitive element capable of responding to variation of ambient temperature.

11. The lighting equipment as in claim 10, wherein said heat sensitive element is made of polymeric substance having positive temperature coefficient.

12. The lighting equipment as in claim 5, wherein said function controllable device is formed of a light sensitive element capable of responding to variation of environmental light intensity.

13. The lighting equipment as in claim 12, wherein said light sensitive element is a combination of photoelectric cell, SCR, and resistor.

14. The lighting equipment as in claim 5, wherein said function controllable device is formed of IC and other electronic elements.

15. The lighting equipment as in claim 5, wherein said function controllable device has the functions of on/off control, or dimming in various speeds and time intervals.

16. The lighting equipment as in claim 5, wherein a plurality of different light sources is connected in series, or parallel, or series-parallel unit.

17. The lighting equipment as in claim 5, wherein a single function controllable light device and other several identical light sources are connected to series, or parallel, or series-parallel unit.

18. The lighting equipment as in claim 5, wherein a single function controllable light source and other several different light sources are connected in series, or parallel, or series-parallel unit.

19. The lighting equipment as in claim 5, wherein different function controllable light sources and other several identical light sources are connected in series, or parallel, or series-parallel unit.

20. The lighting equipment as in claim 5, wherein several different function controllable light sources and other several different light sources are connected in series, or parallel, or series-parallel unit.

21. Function controllable decorative lighting equipment comprising:

a light source where each of its light emitting elements being connected with one end of each lead wire and then being enclosed in a bulb housing, the other end of said lead wire being extended out of said bulb housing to be connected to a power supply;

a functional controllable light source where each of its lighting elements being connected with one end of each lead wire, function controllable devices being connected in series, or parallel, or series-parallel with said lighting elements between said lighting elements and said lead wires, or between said lead wires, wherein said function controllable light source is enclosed in said bulb housing, and extending other terminals of said lead wires out of said bulb housing to a power supply; and connecting means having a plurality of conductors being connected with said extension lead wires of at least one function controllable device in series, or in parallel, or series-parallel, and then being connected to said power supply via said connecting means; wherein said light emitting elements produce light variation effect individually or simultaneously.

22. The lighting equipment as in claim 21, wherein said lighting equipment is protected by an insulation base.

23. The lighting equipment as in claim 21, wherein said lighting element is a tungsten filament.

24. The lighting equipment as in claim 21, wherein said lighting element is a LED.

25. The lighting equipment as in claim 21, wherein said lighting elements are individually operated or combinatorially operated so as to produce a monochromatic light or a variety of lights.

26. The lighting equipment as in claim 21, wherein said function controllable device is formed of a heat sensitive element capable of responding to variation of ambient temperature.

27. The lighting equipment as in claim 21, wherein said heat sensitive element is made of polymeric substance having positive temperature coefficient.

28. The lighting equipment as in claim 21, wherein said function controllable device is formed of a light sensitive element capable of responding to variation of environmental light intensity.

29. The lighting equipment as in claim 21, wherein said light sensitive element is a combination of photoelectric cell, SCR, and resistor.

30. The lighting equipment as in claim 21, wherein said function controllable device is formed of IC and other electronic elements.

31. The lighting equipment as in claim 21, wherein said function controllable device has the functions of on/off control, or dimming in various speeds and time intervals.

32. The lighting equipment as in claim 21, wherein a plurality of different light sources is connected in series, or parallel, or series-parallel unit.

33. The lighting equipment as in claim 21, wherein a single function controllable light source and other several identical light sources are connected to series, or parallel, or series-parallel unit.

34. The lighting equipment as in claim 21, wherein a single function controllable light source and other several different light sources are connected in series, or parallel, or series-parallel unit.

35. The lighting equipment as in claim 21, wherein several different function controllable light sources and other several identical light sources are connected in series, or parallel, or series-parallel unit.

36. The lighting equipment as in claim 21, wherein several different function controllable light sources and other several different light sources are connected in series, or parallel, or series-parallel unit.

* * * * *